US005484254A

United States Patent [19]

Schiffelholz

[11] Patent Number: 5,484,254

[45] Date of Patent: Jan. 16, 1996

[54] CUP STACKING APPARATUS

[76] Inventor: Max Schiffelholz, Peter-Henlein-Strasse 10, D-8870 Gunzburg, Germany

[21] Appl. No.: 39,182

[22] PCT Filed: Aug. 7, 1992

[86] PCT No.: PCT/EP92/01794

§ 371 Date: May 24, 1993

§ 102(e) Date: May 24, 1993

[87] PCT Pub. No.: WO93/03460

PCT Pub. Date: Feb. 18, 1993

[30] Foreign Application Priority Data

Aug. 8, 1991 [DE] Germany ..... 41 26 260.3

[51] Int. Cl.[6] ..... B65F 1/08

[52] U.S. Cl. ..... 414/788.2; 414/754; 414/790.3; 220/571; 198/395; 193/47; 901/47

[58] Field of Search ..... 414/788.2, 788.3, 414/789.9, 403, 790.2, 790.3, 790.4, 790.5, 222, 422, 754; 901/46, 47; 193/2 R, 44, 47; 194/208; 220/571; 198/464.1, 395

[56] References Cited

U.S. PATENT DOCUMENTS

| | | | |
|---|---|---|---|
| 127,184 | 5/1872 | Mulcahy | 220/571 X |
| 3,232,453 | 2/1966 | Rukavina | 414/788.2 X |
| 3,313,943 | 4/1967 | Sager | 414/754 X |
| 3,708,679 | 1/1973 | Stock et al. | 198/395 X |
| 4,054,196 | 10/1977 | Schäufele et al. . | |

FOREIGN PATENT DOCUMENTS

| | | | |
|---|---|---|---|
| 672109 | 10/1963 | Canada | 414/788.2 |
| 0301978 | 7/1988 | European Pat. Off. . | |
| 2395917 | 1/1979 | France . | |
| 2580418 | 4/1985 | France . | |
| 2631477 | 5/1988 | France . | |
| 230284 | 1/1911 | Germany . | |
| 1960118 | 6/1971 | Germany | 414/790.3 |
| 98915 | 4/1991 | Japan | 414/788.2 |
| 1535922 | 12/1978 | United Kingdom . | |

OTHER PUBLICATIONS

Partial translation of French Patent Application 2,580,418, dated Apr. 16, 1985.

*Primary Examiner*—Frank E. Werner
*Attorney, Agent, or Firm*—Knobbe, Martens, Olson & Bear

[57] ABSTRACT

The cup return automat has a cup insertion chamber (1), a cup collection chamber (10) and a stacking shaft (9) arranged over the cup collection chamber for the cups to be stacked in the stacking shaft (9), with a device for ejecting the formed cup stack (5") laterally into the cup collection chamber (10). In between the cup insertion chamber (1) and the stacking shaft (9) there is located a transfer device, which only allows any cup received in the cup insertion chamber (1) to pass into the stacking shaft (9) when in the cup orientation permitting the cup stacking and with the cup opening turned downwards.

12 Claims, 9 Drawing Sheets

CUP STACKING APPARATUS

This application is a 371 of PCT/EP92/01794 filed Aug. 7, 1992.

This invention relates to a cup return automat with a cup insertion chamber and a cup collecting chamber.

Cup return automats should provide an incentive for used cups, especially drinking cups, to be collected and passed on to an organized waste disposal facility and if desired waste recycling. Accordingly, the new cups are dispensed in return for a deposit, which is refunded by cup return automats on insertion of the used cup. In order to prevent misuse, the cup is provided with a suitable marking. The acceptance of the used cup by the cup return automat, or at least the return of deposit, only then takes place when the cup is actually one with the right marking and the marking is recognized as correct by the cup return automat.—In order to be able to implement such a disposal system in practice, it must have as simple and inexpensive a construction as possible with at the same time the largest possible collection capacity for the cups, so that the installation of such automats is within one's means and justifiable in cost terms and the work of emptying and servicing the automats does not have to be carried out on a too frequent rota.—The invention is based on the object of providing a cup return automat of the kind initially referred to fulfilling these requirements.

The cup return automat according to the invention meeting this object is characterized by a stacking shaft arranged over the cup collection chamber with a reception opening provided at the upper shaft end for the cups to be stacked in the stacking shaft and with a device for ejecting the formed stack of cups into the cup collection chamber, and by a transfer device provided between the cup insertion chamber and the stacking shaft which only allows any cup received in the cup insertion chamber to pass into the receiving opening of the stacking shaft when in the cup orientation permitting the cup stacking and with the cup opening turned downwards.

The advantage obtained with the invention consists in that the cups do not fill up the cup collection chamber in complete disorder and then with a correspondingly great space requirement, but are first stacked in space-saving manner, so that there results an optimally small space requirement for a correspondingly large number of cups, which cup return automat also has a very large collection capacity. The stacking operation is however only possible when each cup already has that orientation which it will finally have in the stack. The transfer device preceding the stacking shaft takes care of this, which according to the invention also finds use in allowing only cups standing on their heads and accordingly with a down-turned cup opening to be stacked, so that residual contents possibly remaining the cups run out and can be caught.

The prior orientation of the cups required for the stacking operation can then be implemented in an especially simple manner if use is made of the circumstances in which the cups are provided with a marking for the purposes of the return of deposit already mentioned. An embodiment of the invention making use of this and therefore particularly simple and preferred is characterized in that the transfer device comprises a guide cylinder receiving the cups in an orientation substantially parallel to the axis and open at the top and bottom ends, and which at the top adjoins an opening for passage of the cups provided in the bottom of the cup insertion chamber and at the bottom opens above the reception opening of the stacking shaft, further in that the guide cylinder is provided with a catch member which is movable in controllable manner between two states, where it retains the cup in the guide cylinder in one state and enables it to fall through in the other state, and in that the guide cylinder is fitted with a sensor for testing a marking provided on the cup wall, wherein the catch member and the sensor are so arranged relative to one another, that the marking can only be detected by the sensor with a downwardly turned cup opening of a cup retained by the catch member in the guide cylinder, and wherein the test results of the sensor control the catch member in relation to release of the cup. Each cup is as a result initially retained by the catch member in the guide cylinder, until the sensor has checked the marking. If the sensor detects the marking, the cup has the right orientation and is released by the catch member to fall through into the stacking shaft. If however the sensor does not detect any marking, the cup has the wrong orientation in the guide cylinder and must be turned over. This can be effected most simply by hand if, according to a further proposal of the invention, the catch member is so arranged in relation to the opening of passage in the bottom of the cup insertion chamber in the guide cylinder that a cup retained by the catch member in the guide cylinder projects upwardly out of the guide cylinder into the cup insertion chamber. The cup with the wrong orientation can then be grasped manually by its part still projecting into the cup insertion chamber, be taken out of the guide cylinder, turned over and be inserted in the guide cylinder again in the now correct orientation.

In particular it is advantageous if the sensor is formed by a reflective light beam detector arranged outside the guide cylinder at a window provided in the cylinder wall, with a detection region directed into the interior space of the guide cylinder and by a signal processing circuit electrically connected to the reflective light beam detector and which evaluates the marking located on the cup and detected by the reflective light beam detector and controls the catch member for the cup release. The sensor then serves not only to detect the cup orientation in the guide cylinder but simultaneously checks whether the cup carries the correct marking for the return of deposit. Advantageously, the catch member forms a stop for the cup rim preventing the cup falling through the guide cylinder in its state retaining the cup in the guide cylinder. It is advantageous in structural terms so to design the arrangement that the catch member is a rod movable in the direction of its axis by a controllable drive member and which runs in a diametral plane passing through the axis of the guide cylinder and which is inserted into the interior space of the guide cylinder in its state retaining the cup in the guide cylinder and is retracted from the interior space in the state releasing the cup.

In order that the stacking shaft shall be emptied correctly into the cup collection chamber when the stack of cups in the stacking shaft has built up to its largest possible height, in the preferred embodiment, a light beam detector is arranged outside the upper end region of the stacking shaft, with a detection region directed into the interior of the stacking shaft, and the output signals of the light beam detector detecting the build up of the cup stack serve to control the device for ejecting the formed stack of cups into the cup collection chamber. The ejection itself preferably takes place in the lateral direction out of the stacking shaft, accordingly transverse to the shaft axis, because with other emptying methods, obstructions and even operational faults can easily arise from sticking and encrustations, arising from the residues of the cup contents. An especially preferred embodiment for such lateral ejection of the cup stack is characterized in that the stacking shaft is formed by guide members running in the longitudinal direction of the shaft, arranged about the periphery of the shaft cross-section and enclosing the cups therebetween, which members are so movable relative to one another out of their arrangement enclosing the cups that they open the stacking shaft over at least half of the shaft periphery for the sideways ejection of the stack of cups. An embodiment which is especially advantageous in structural and functional terms is characterized in further development of the invention in that one of the guide members is formed as a shell curved over at most half the shaft periphery and which is hinged about an axis running in the shaft longitudinal direction, outside the shaft cross-section, so that the shell swings in relation to the plane intersecting the same and passing through its hinge axis and also through the axis of the stacking shaft so that the shell part lying on one side of this plane swings outwardly, out of the shaft cross-section and the shell part lying on the other side of the plane swings into the shaft cross-section, whereby the in-swinging shell part ejects the cup stack laterally out of the stacking shaft thus simultaneously opened by the out-swinging shell part. The hinge axis of the shell advantageously lies close by the peripheral surface of the stacking shaft, which offers the advantage of a small swinging path for the shell on ejection of the cup stack. The other guide members apart from the shell forming the stacking shaft are guide rods diametrically opposed to the shell in the simplest and most advantageous embodiment. Moreover, the arrangement is best so designed that the shell is held by the force of a spring in the position enclosing the cups and a pull magnet is provided as a swinging drive with its pull magnet armature connected to pull on the shell at its shell part which swings out of the shaft cross-section. The pull magnet is controlled by the aforementioned light beam detector at the upper end of the stacking shaft.

Finally it is advantageous if the stacking shaft has a shaft bottom provided with at least one drain opening and a catch tray is provided in the cup collection chamber below the stacking shaft for cup contents which run out. Residual contents can then run out of the cups through the drain opening in the shaft bottom into the catch tray.

The invention will be explained in more detail below with reference to an embodiment shown in the drawings, in which.

Figure 2:
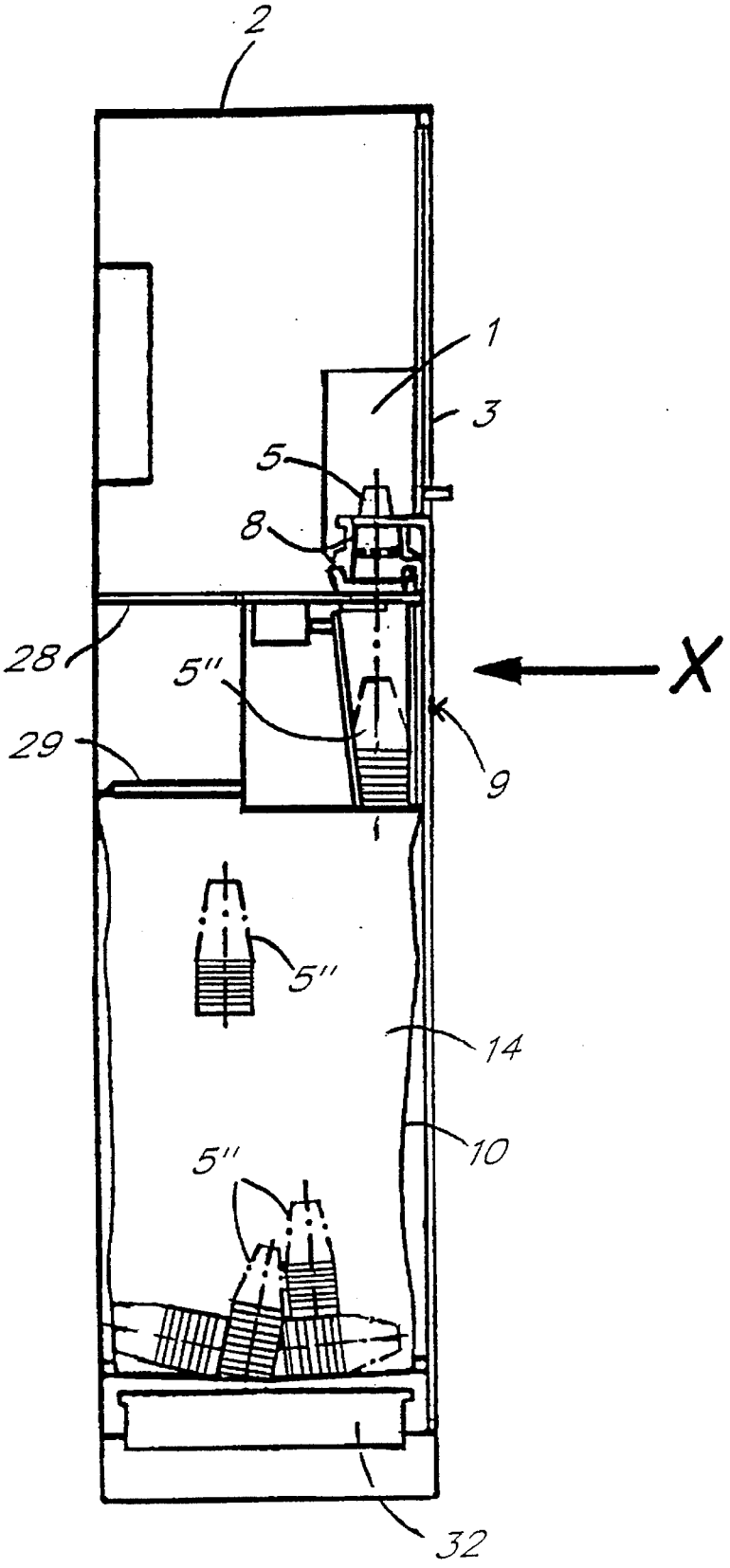
FIG. 2 is the section II—II in FIG. 1.
Figure 3:
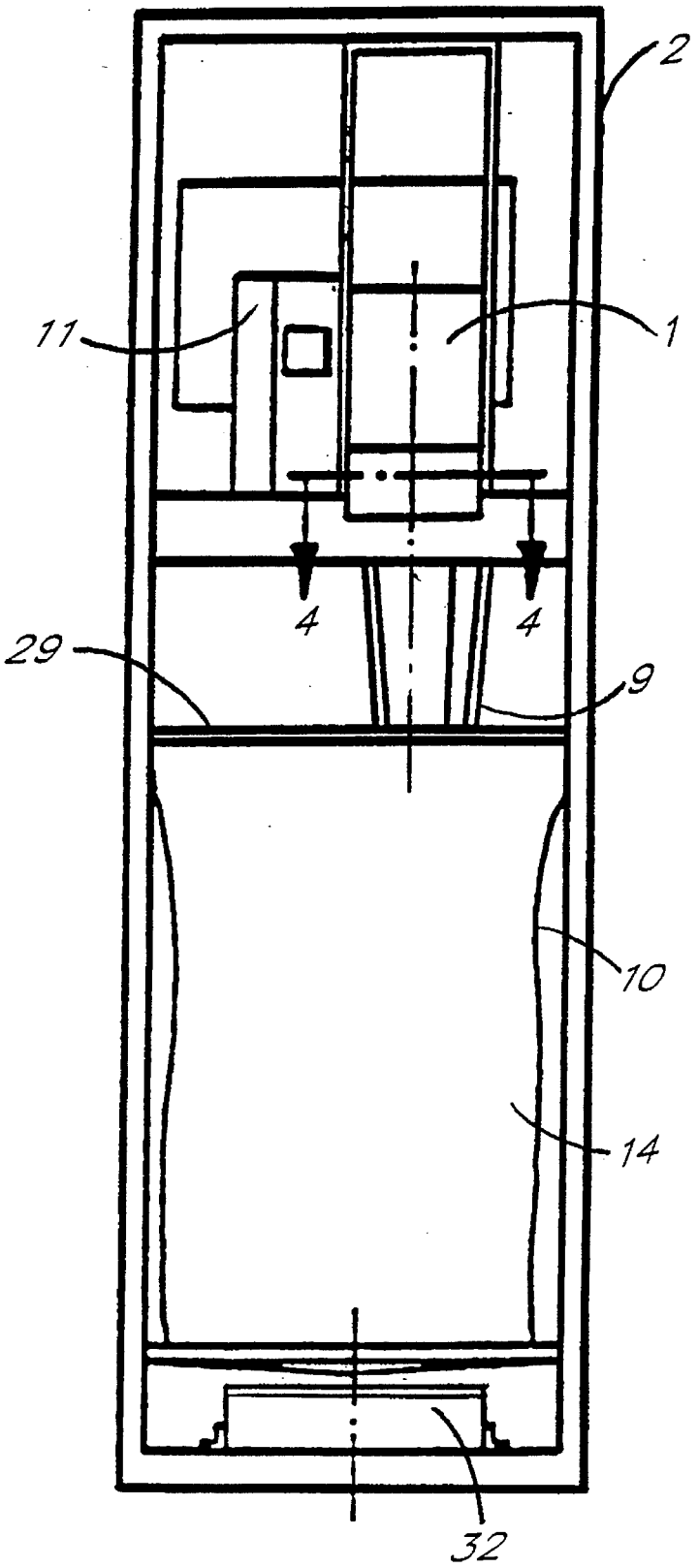
Figure 4:
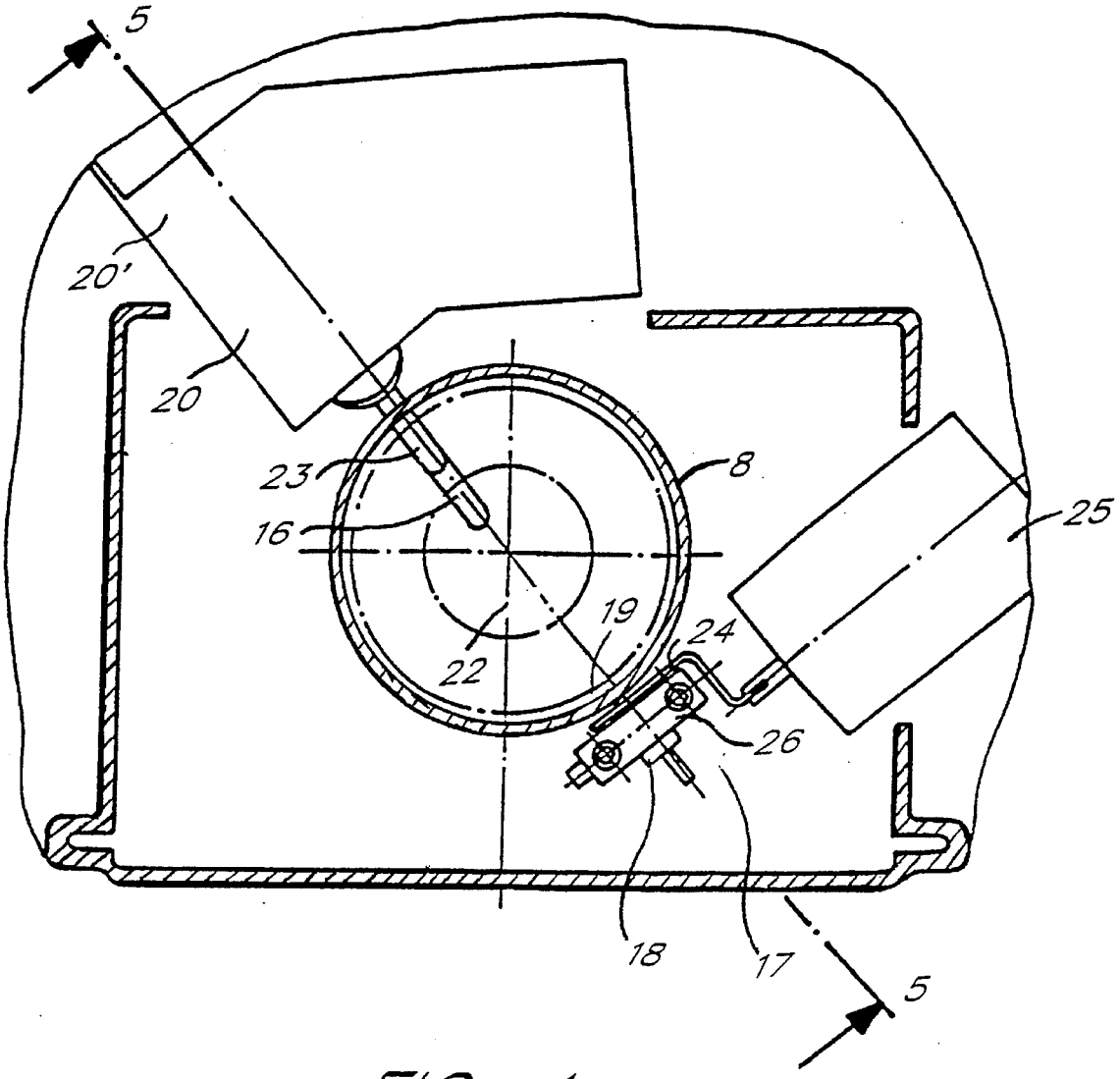
Figure 5:
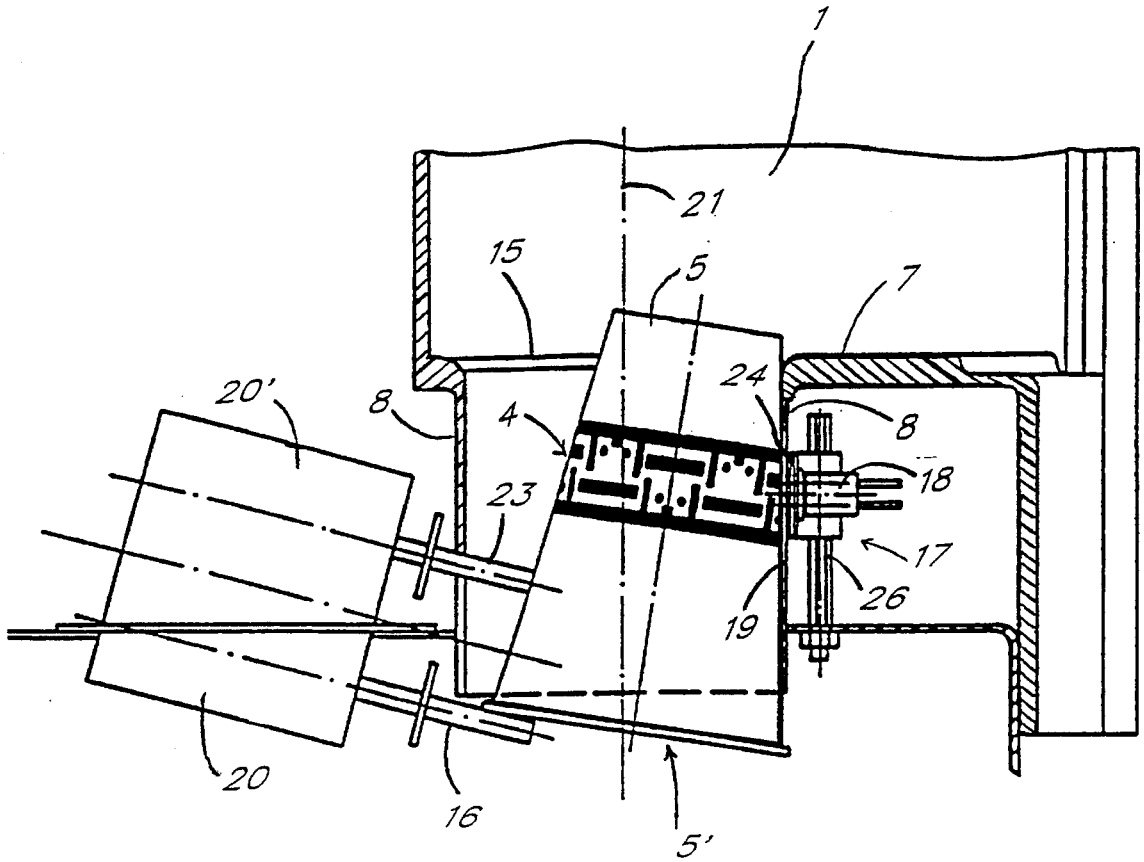
Figure 6:
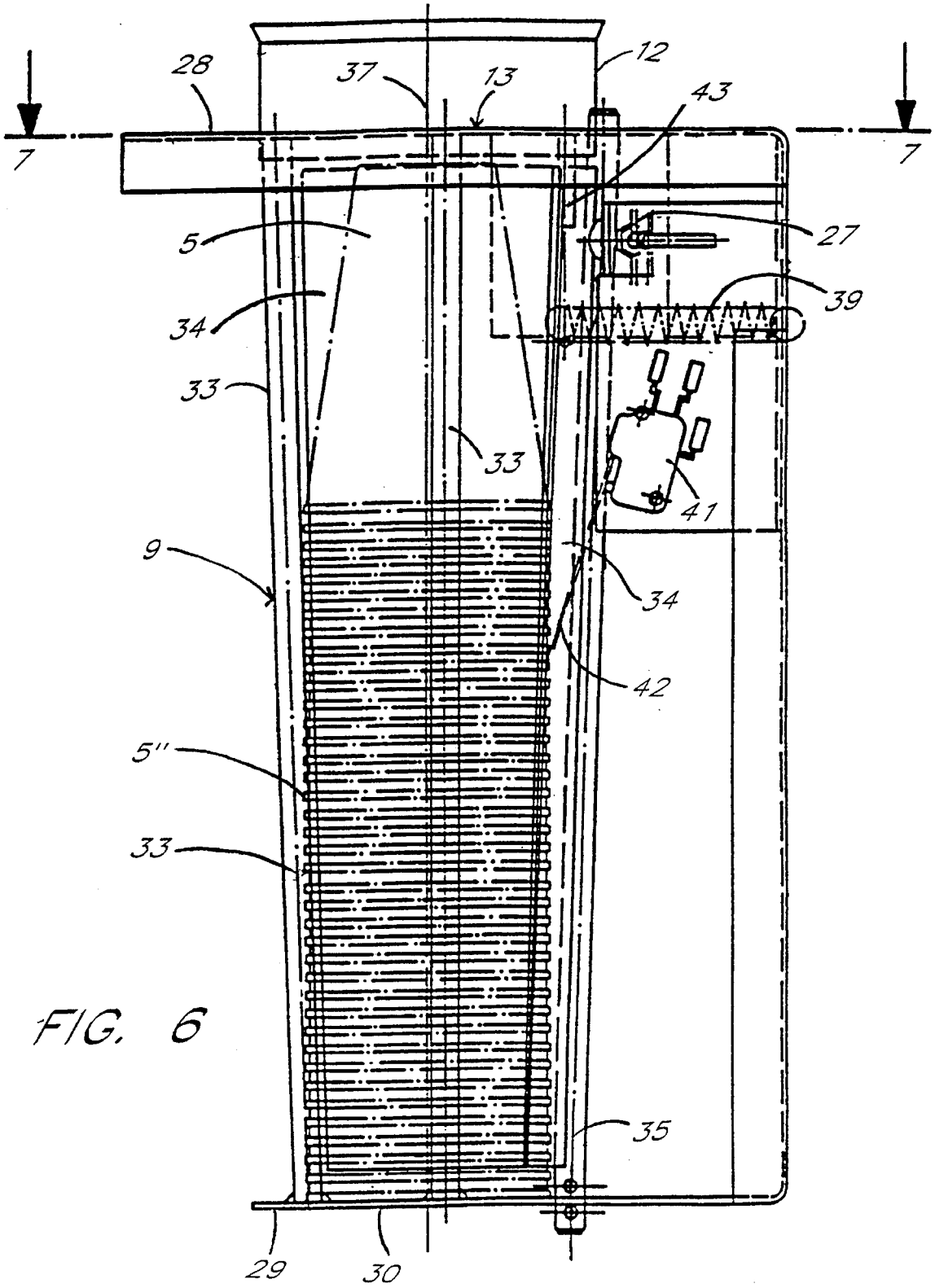
Figure 7:
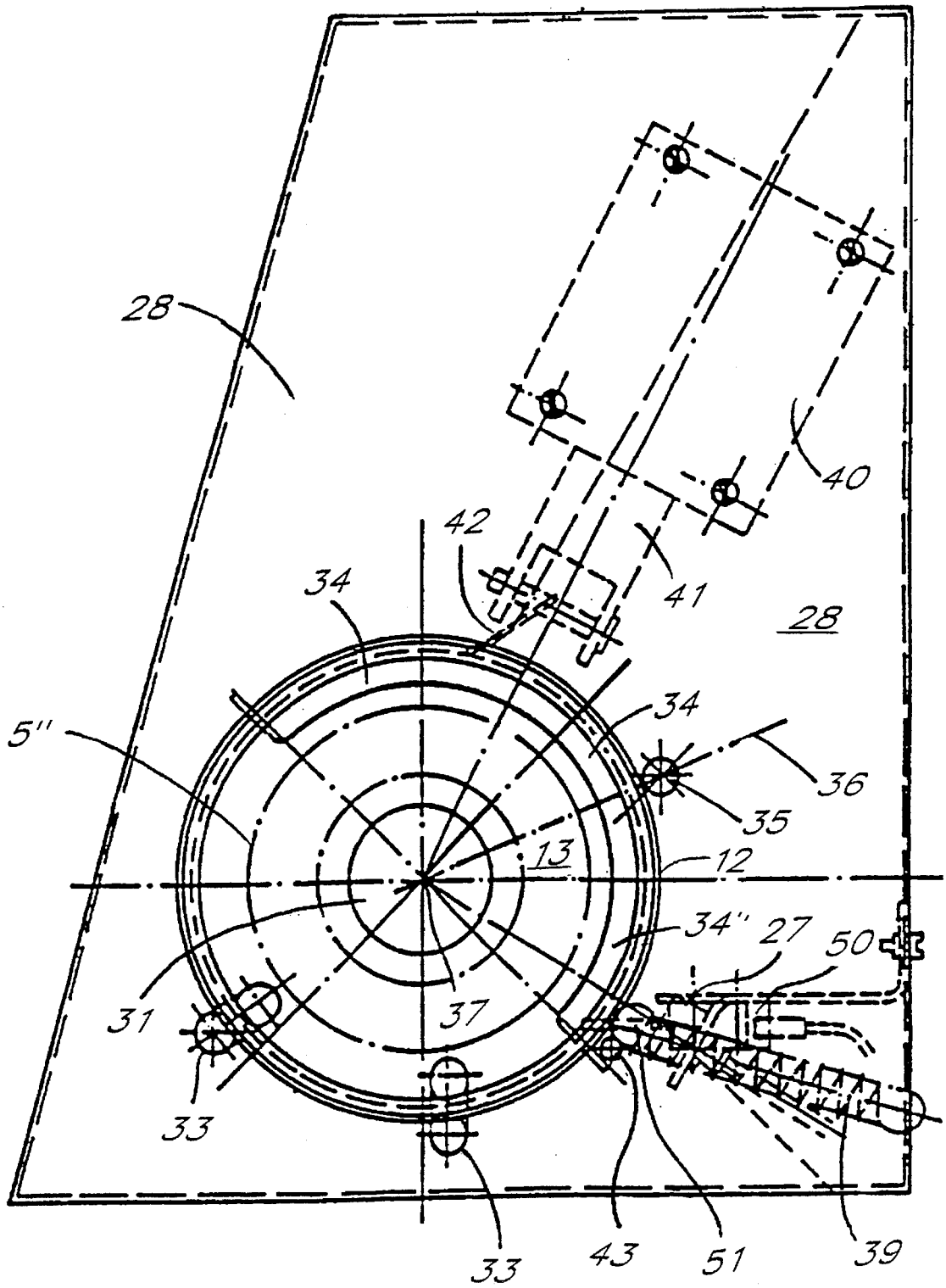
Figure 8:
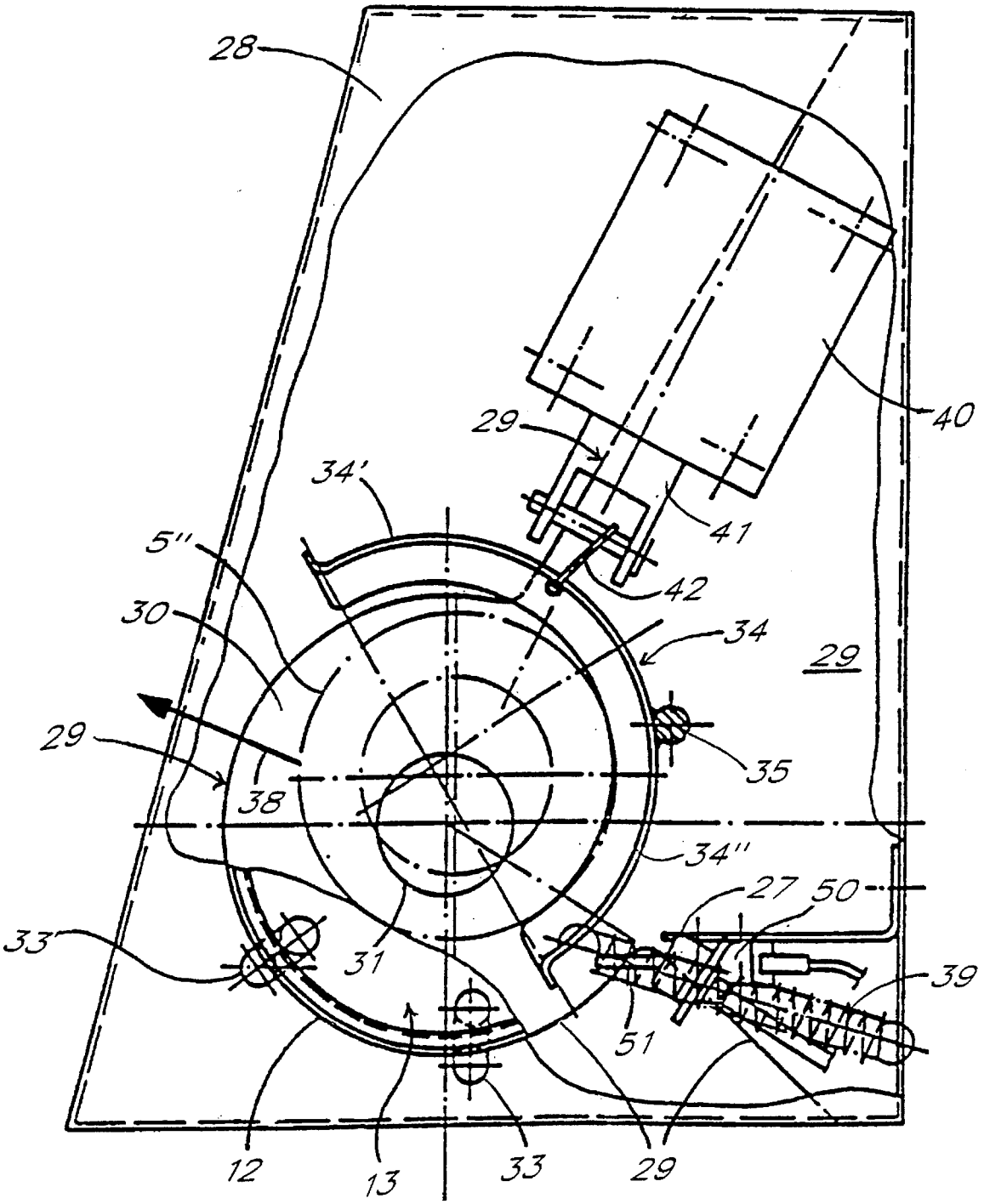
Figure 9:
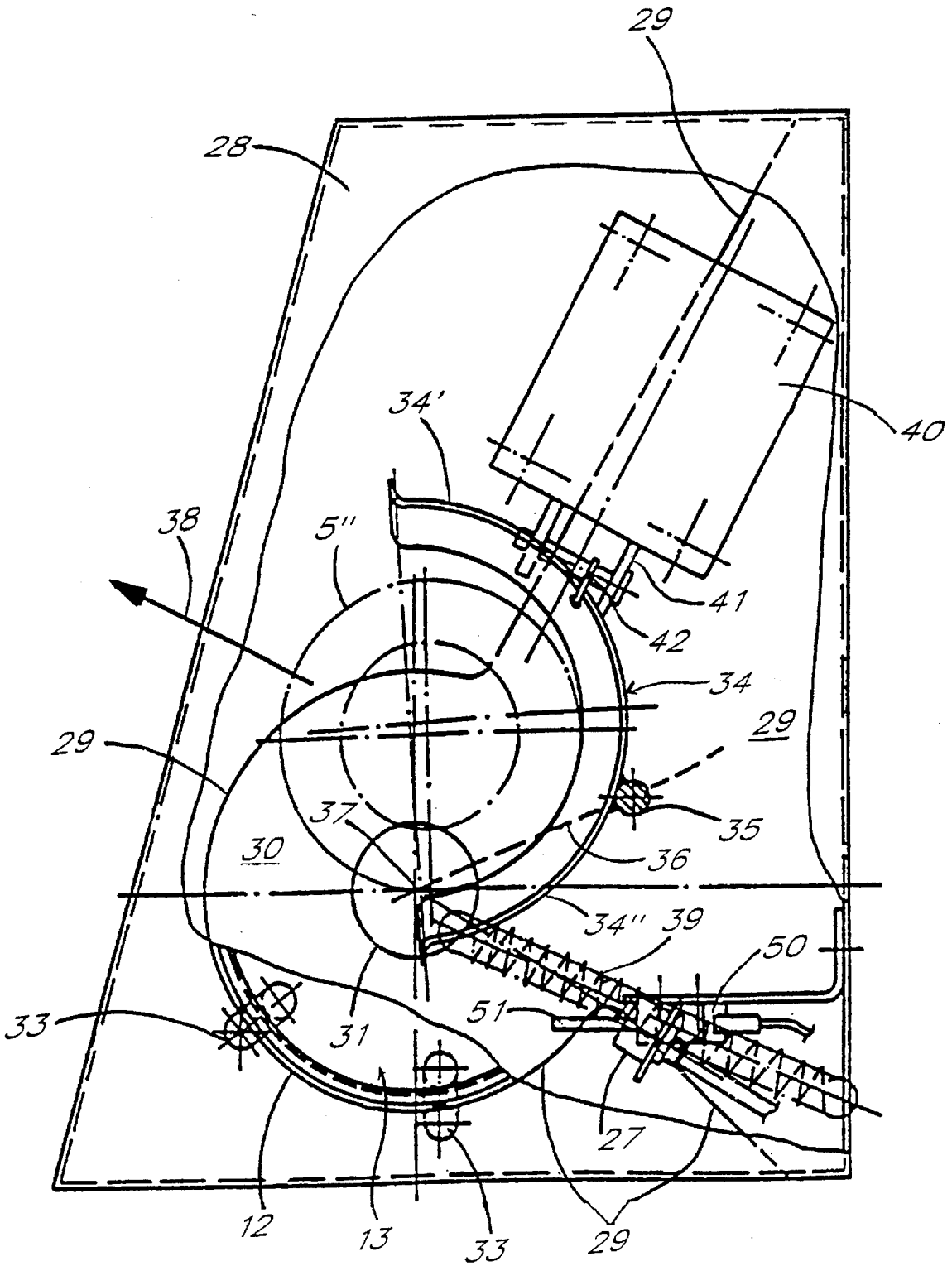

FIG. 3 is the view of the cup return automat according to FIGS. 1 and 2 in the direction of the arrow X in FIG. 2 with the front door removed, FIG. 4 is the section IV—IV in FIG. 3, FIG. 5 is the section V—V in FIG. 4, FIG. 6 is a view of the stacking shaft of the cup return automat in the direction of the arrow X in FIG. 2, FIG. 7 is the plan view of the stacking shaft according to VII—VII in FIG. 6, with the stacking shaft in its closed state, FIG. 8 shows the item of FIG. 7 with a partially broken away wall and in partially opened state of the stacking shaft, FIG. 9 shows the item of FIG. 8 in the fully opened state of the stacking shaft.

Figure 1:
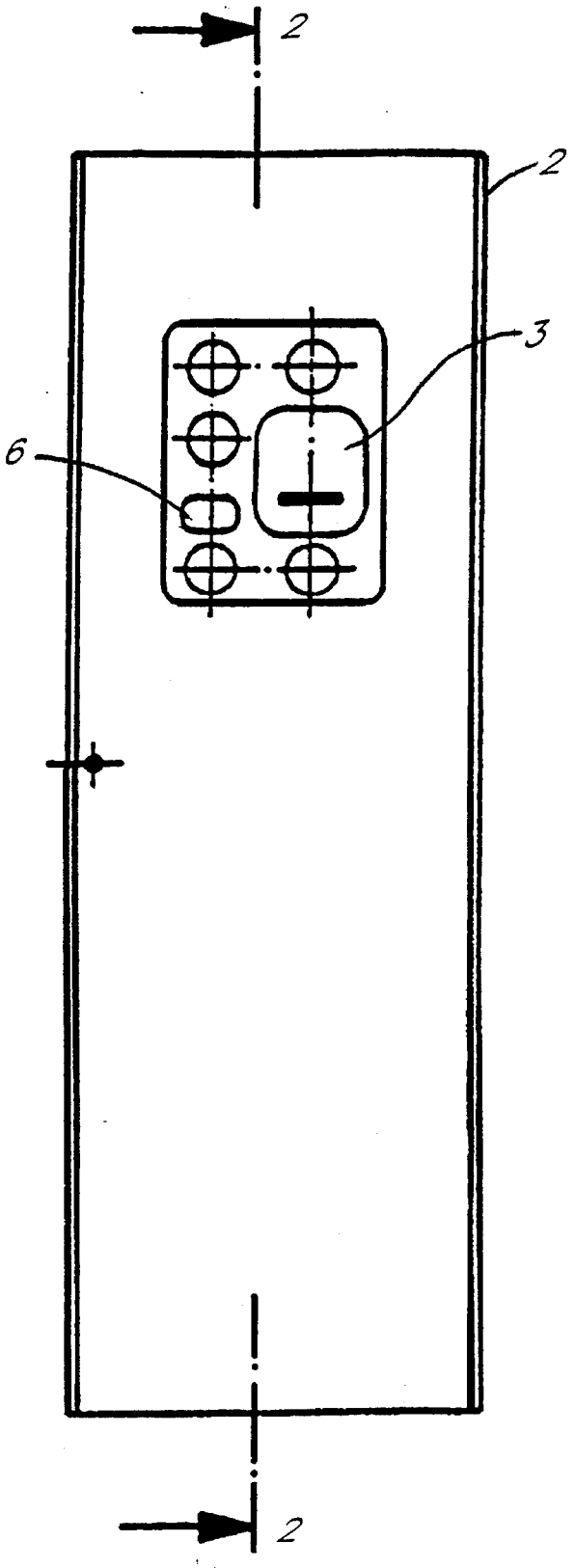
FIG. 1 is a front view of a cup return automat.

The cup return automat 2 shown in FIGS. 1 to 3 has a cup insertion chamber 1, which can be closed on the outside by a sliding door 3. A return of deposit takes place for an inserted cup 5 recognized as correct from its marking 4 (cf. FIG. 5) and accepted by the cup return automat 2; the deposit money is contained in a coin return apparatus 11 indicated in FIG. 3 and can be taken out of the return opening 6 (cf. FIG. 1). At the bottom 7 of the cup insertion chamber 1 there adjoins a guide cylinder 8 receiving the cup 5, being open at the top to the cup insertion chamber 1 and open at the bottom. Below the guide cylinder 8 there is provided a stacking shaft 9, in which the cups 5 which fall down out of the guide cylinder 8 through a guide ring 12 into the receiving opening 13 of the stacking shaft 9 are stacked into cup columns 5". When the stacking shaft 9 is full, the column 5" of cups, which can comprise approximately 40 cups, is pushed sideways out of the stacking shaft 9 into a collection chamber 10, in which a waste bag 14 or the like can be stretched for example, in order to receive the stacks 5" of cups. The guide cylinder 8 is part of a transfer device, which only allows any cup 5 taken from the cup insertion chamber 1 to pass into the receiving opening 13 of the stacking shaft 9 with the cup orientation allowing the cup stacking, namely with the cup opening 5 [5'] turned downwards. The guide cylinder 8 is connected at the top to an opening 15 for the passage of the cups 5 in the bottom 7 of the cup insertion chamber 1. At the bottom it opens above the interposed guide ring 12 into the receiving opening 13 of the stacking shaft 9. The guide cylinder 8 is provided with a catch member 16 which is movable in controlled manner between two states, namely between a state according to FIG. 5 retaining the cup 5 in the guide cylinder 8 and a state releasing the cup to fall through into the stacking shaft 9. In the first state the catch member 16 forms a stop for the cup rim preventing the cup 5 falling through the guide cylinder 8. Furthermore the guide cylinder 8 is provided with a sensor indicated generally at 17, which serves to test the marking 4 provided on the cup wall. The catch member 16 and the sensor 17 are so arranged relative to one another that the sensor 17 can only detect the marking 4 when the cup 5 is retained by the catch member 16 in the orientation required for the stacking, standing on its head. If the cup 5 has this correct orientation, the appropriate test results of the sensor serve to move the catch member 16 into the state releasing the cup 5. Moreover the catch member 16 is arranged in the guide cylinder 8 at such a height that a cup 5 retained by the catch member 16 projects upwardly somewhat into the cup insertion chamber 1, at least far enough for it to be grasped by hand by the projecting part, to be turned over and be inserted again in the right orientation in the guide cylinder 8, when the test results of the sensor 17 signal the wrong orientation of the cup 5 in the guide cylinder 8 and thus no release of the cup for falling through into the stacking shaft 9 follows.

The sensor 17 is a reflective light beam detector 18 in the embodiment, which is arranged outside the guide cylinder 8 by a window 19 provided in the cylinder sidewall. The detection region of the reflective light beam detector 18 is directed through this window 19 into the interior space of the guide cylinder 8. A signal processing circuit, not shown in the drawings, connected to the reflective light beam detector 18 evaluates the marking 4 of the cup detected by the reflective light beam detector 18 and controls the catch member 16 for the purposes of cup release in dependence on the results of the evaluation. The catch member 16 is a rod movable in the direction of its axis by a controllable drive member, in the embodiment a pull magnet 20, which rod runs in a diametral plane 22 passing through the axis 21 of the guide cylinder 8 and is moved in its state retaining the cup 5 in the guide cylinder 8 into the interior space of the guide cylinder 8 and is retracted from the interior space in the state releasing the cup 5. In FIGS. 4 and 5 a further rod 23 can be seen, in the direction of the cylinder axis 21 between the catch member 16 and the reflective light beam detector 18, being movable by its own pull magnet 20' and which served to tilt the cup 5 in the manner apparent in FIG. 5 against the window 19 for the purpose of detecting the marking 4, in order to approach the cup wall bearing the marking 4 as close as possible to the reflective light beam detector 18, so that a reliable detection of the marking is ensured. The reflective light beam detector 18 can be provided with a protective shutter 24 which is shown in FIG. 4 in its state covering the reflective light beam detector 18 and which can be moved by a further pull magnet 25 to expose the reflective light beam detector 18 for the purposes of the marking test. Moreover there is the possibility of adjusting the reflective light beam detector 18 in axial direction of the guide cylinder 8 along a holder 26, in order to adjust the mutual relationship between the catch member 16 and the reflective light beam detector 18 and thus to be able to adapt to different arrangements of the marking 4 on the cup wall.

In the upper end region of the stacking shaft 9 there is located an external light beam detector 27, whose detection region is directed into the interior space of the stacking shaft 9. This light beam detector 27 does not only indicate that a cup has passed the light beam detector 27 on falling into the stacking shaft 9 but—when the signal remains present for a long time—that the stacking shaft 9 is full to the top, thus that the cup column 5" has built up to the full height. In this case the output signal of the light beam detector 27 serves to control the device for ejecting the formed cup stack into the cup collection chamber 10. In detail the stacking shaft 9 extends between an upper floor 28 and a lower floor 29, where the receiving opening 13 is located in the upper floor 28 and the lower floor at the same time forms the bottom 30 of the stacking shaft 9 in which a drain opening 31 is provided, through which residual contents still present in the cups 5 can run out and into a catch tray 32 provided on the bottom of the cup collection chamber 10. The upper floor 28 is shown partially broken away in FIGS. 8 and 9, in order to be able to show in the drawings the method which operates when ejecting the stack of cups. The stacking shaft 9 is formed by guide members 33, 34 running in the longitudinal direction of the shaft between the two floors 28, 29 and arranged at the periphery of the shaft cross-section, which members enclose the cups 5 therebetween in the closed stacking shaft 9. However, these guide members 33, 34 are mutually adjustable out of this arrangement enclosing the cups 5 so as to open and clear the stacking shaft 9 over at least the half of the shaft periphery for sideways ejection of the cup column 5". To this end one of the guide members is formed as shell 34 curved over half the shaft periphery. This shell 34 is hinged about an axis 35 running outside the shaft cross-section in the shaft longitudinal direction. In relation to the plane 36 which intersects the shell 34 and passes through the hinge axis 35 as well as through the axis 37 of the stacking shaft 9, the shell 34 therefore swings with the shell part 34' lying to one side of this plane, in FIGS. 7 to 9 the left side, swinging out of the shaft cross-section and with the other shell part 34" lying in FIGS. 7 to 9 on the right swinging into the shaft cross-section, as is shown in FIGS. 8 and 9. With this swinging the shell part 34' swinging into the shaft cross-section ejects the cup column 5" sideways in the direction of the arrow 38 out of the stacking shaft 9 opened at the same time by the out-swinging shell part 34". The hinge axis 35 of the shell 34 lies close to the peripheral surface of the stacking shaft 9, so that a short swinging path for the shell 34 results. In FIG. 7 the stacking shaft 9 is closed, in FIG. 8 it is half open, in FIG. 9 fully open. The other guide members are guide rods 33 diametrically opposite to the shell 34. Both these guide rods 33 and the shell 34 and its hinge axis 35 are slightly inclined to the axis of the stacking shaft 9, so that the cross-section of the stacking shaft 9 tapers down slightly from the top to the bottom, as can clearly be seen in FIG. 6. The shell 34 is held in the position enclosing the cups 5 by the force of a tension spring 39 attached to the shell part 34". A pull magnet 40 serves as a swinging drive, whose pull armature 41 is connected tractively to the shell 34 by a link 42, at the part 34' swinging out of the shaft cross-section. The closed position of the shell 34 is monitored by a limit switch 41, which carries a sensor 42 actuated by the shell 34 in its closed position. The sensor actuation is effected by the part 34" of the shell swinging into the shaft cross-section, to which the tension spring 39 is attached. In the closed position of the shell 34 the shell part 34" bears under the action of the tension spring 39 on a stop pin 43 arranged on the upper floor 28.

I claim:

1. An apparatus for collecting cups having an opening at one end, comprising:

a cup insertion chamber having a plurality of walls defining a side opening and a floor defining a bottom opening;

a cup collection chamber disposed below said insertion chamber and having a plurality of walls and a top opening;

a transfer device positioned between said cup insertion chamber and said cup collection chamber allowing a cur received in said side opening of said cup insertion chamber to fall in a path through said transfer device and then into said cup collection chamber only when the open end of said cup is turned downwards, and wherein said transfer device comprises:

a guide chamber having walls defining an upper opening in communication with said bottom opening into said insertion chamber, and a lower opening in communication with said top opening into said collection chamber;

a catch member, which is movable in a controllable manner between two states: a first state in which said member extends into said path of said cup to prevent said cup from falling through said transfer device and a second state in which said member retracts and said cup is released to fall through said transfer device into said collection chamber; and a sensor, said sensor being responsive to a marking on said cup to actuate said catch member into said second state to release said cup to fall into said collection chamber only when a cup in said guide chamber has its open end turned downwardly.

2. The apparatus of claim 1, wherein said guide chamber is a cylinder and wherein said transfer device comprises:

a window in one of said walls of said guide cylinder wherein said sensor is an optical sensor positioned outside of said cylinder adjacent said window; and a tilt member extending into said cylinder;

wherein said marking can only be detected by said sensor with said cup having its opening downwardly turned when said cup is retained by said catch member in said guide cylinder and when said tilt member positions said cup against said window.

3. The apparatus of claim 1, wherein said catch member is arranged in relation to said cup insertion chamber so that a cup retained by said catch member projects upwardly out of said transfer device into said cup insertion chamber.

4. The apparatus of claim 1, wherein said sensor comprises:

a reflective light beam detector having a detection region directed into said transfer device; and a signal processing circuit electrically connected to said detector for evaluating said marking on said cup and detected by said detector, and for controlling said catch member for release of said cup.

5. The apparatus of claim 1, wherein said catch member forms a stop for a rim of said cup to prevent said cup from falling through said transfer device when said catch member is in said first state for retaining said cup.

6. The apparatus of claim 1, wherein said guide chamber defines an interior space for receiving said cup in said transfer device and wherein said device further comprises a controllable drive for moving said catch member, said member comprising a rod movable by said drive into said interior space of said guide chamber wherein the catch member is in said first state for retaining said cup and said rod is movable by said drive out of said interior space when said catch member is in said second state for releasing said cup.

7. The apparatus of claim 1, further comprising:

a stacking shaft having a periphery and an inner space for forming a stack of a plurality of said cups, said shaft being arranged over said cup collection chamber and comprising an upper portion for receiving said cups, wherein said transfer device allows cups to fall into said shaft to form said stack; and a device for ejecting said stack of cups from said stacking shaft into said cup collection chamber.

8. The apparatus of claim 7, further comprising a light beam detector arranged outside an upper end region of said stacking shaft, with a detection region directed into said stacking shaft, and wherein output signals of said light beam detector detecting a build up of cups to form said stack of cups serve to control said device for ejecting said formed stack of cups into said cup collection chamber.

9. The apparatus of claim 7, wherein said stacking shaft comprises a plurality of guide members arranged in a longitudinal direction and defining said periphery of said stacking shaft so as to enclose said cups therebetween, said guide members being movable relative to one another from their position enclosing said cups into a position where they open said stacking shaft over at least half of said shaft periphery to permit sideways ejection of said stack of cups.

10. The apparatus of claim 9, wherein one of said guide members is formed as a shell curved over at most half the shaft periphery and which is hinged about a hinge axis running in the shaft longitudinal direction, outside the shaft periphery, so that one part of said shell swings outwardly out of the shaft periphery, and another part of said shell swings into said shaft periphery, whereby said in-swinging shell part ejects said cup stack laterally out of said stacking shaft.

11. The apparatus of claim 10, wherein said hinge axis of said shell lies close to the periphery of said stacking shaft.

12. The apparatus of claim 7, wherein said stacking shaft comprises a shaft bottom having at least one drain opening therein, and said apparatus further comprises a catch tray in said cup collection chamber below said stacking shaft for catching any contents which run out of said cups.

* * * * *

UNITED STATES PATENT AND TRADEMARK OFFICE

CERTIFICATE OF CORRECTION

PATENT NO. : 5,484,254

DATED : January 16, 1996

INVENTOR(S) : Max Schiffelholz

It is certified that error appears in the above-indentified patent and that said Letters Patent is hereby corrected as shown below:

Column 6, lines 23-24, change "a cur received" to -- a cup received --.

Signed and Sealed this

Eleventh Day of November, 1997

*Attest:*

Bruce Lehman

BRUCE LEHMAN

*Attesting Officer*

*Commissioner of Patents and Trademarks*